US006290342B1

(12) United States Patent
Vo et al.

(10) Patent No.: US 6,290,342 B1
(45) Date of Patent: Sep. 18, 2001

(54) PARTICULATE MARKING MATERIAL TRANSPORT APPARATUS UTILIZING TRAVELING ELECTROSTATIC WAVES

(75) Inventors: Tuan Anh Vo, Hawthorne, CA (US); Dan A. Hays, Fairport, NY (US); Eric Peeters, Fremont, CA (US); Abdul M. Elhatem, Redondo Beach, CA (US); Kaiser H. Wong, Torrance, CA (US); Joel A. Kubby, Rochester, NY (US); Jaan Noolandi, Mountain View, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/163,839

(22) Filed: Sep. 30, 1998

(51) Int. Cl.[7] ..... B41J 2/175

(52) U.S. Cl. ..... 347/85; 347/55; 347/83

(58) Field of Search ..... 347/7, 20, 21, 347/44, 46, 55, 83, 85, 43, 59; 29/890.1; 399/258

(56) References Cited

U.S. PATENT DOCUMENTS

| | | | |
|---|---|---|---|
| 2,573,143 | 10/1951 | Jacob | 178/5.2 |
| 2,577,894 | 12/1951 | Jacob | 346/75 |
| 3,152,858 | 10/1964 | Wadey | 346/75 |
| 3,572,591 | 3/1971 | Brown | 239/337 |
| 3,977,323 | 8/1976 | Pressman et al. | 101/426 |
| 3,997,113 | 12/1976 | Pennebaker, Jr. | 239/15 |

(List continued on next page.)

FOREIGN PATENT DOCUMENTS

| | | |
|---|---|---|
| 0 655 337 A2 | 5/1995 | (EP) . |
| 0 726 158 A1 | 8/1996 | (EP) . |
| 53-035539 | 4/1978 | (JP) . |
| 55-019556 | 2/1980 | (JP) . |
| 55-028819 | 2/1980 | (JP) . |
| 56-146773 | 11/1981 | (JP) . |
| 58-224760 | 12/1983 | (JP) . |
| 60-229764 | 11/1985 | (JP) . |
| 362035847A | 2/1987 | (JP) . |
| 2-293151 | 12/1990 | (JP) . |
| 4-158044 | 6/1992 | (JP) . |
| 4-182138 | 6/1992 | (JP) . |
| 5-4348 | 1/1993 | (JP) . |
| 5-193140 | 8/1993 | (JP) . |
| 5-269995 | 10/1993 | (JP) . |
| WO 93/11866 | 6/1993 | (WO) . |
| WO 94/18011 | 8/1994 | (WO) . |
| WO 97/01449 | 1/1997 | (WO) . |
| WO 97/27058 | 7/1997 | (WO) . |

OTHER PUBLICATIONS

F. Anger, Jr. et al. Low Surface Energy Fluoro–Epoxy Coating for Drop–on–Demand Nozzles, *IBM Technical Disclosure Bulletin*, vol. 26, No. 1, p. 431, Jun. 1983.

N. A. Fuchs. The Mechanics of Aerosols, *Dover Publications, Inc.*, p. 79, 367–377, 1989 (Originally published in 1964 by Pergamon Press Ltd.).

Hue Le et al. Air–Assisted Ink Jet with Mesa–Shaped Ink–Drop–Forming Orifice, *Presented at the Fairmount Hotel in Chicago and San Jose*, Fall 1987, p. 223–227.

No author listed, Array Printers Demonstrates First Color Printer Engine, *The Hard Copy Observer Published by Lyra Research, Inc.*, vol. VIII, No. 4, p. 36, Apr. 1998.

*Primary Examiner*—John Barlow
*Assistant Examiner*—Robert D. Loper, Jr.

(57) ABSTRACT

A device for the transport of particulate marking material includes a plurality of interdigitated electrodes formed on a substrate. An electrostatic traveling wave may be generated across the electrodes to sequentially attract particles of marking material, and thereby transport them to a desired location. The electrodes may be integrally formed with driving circuitry, and may be staggered to minimize or eliminate cross-talk.

12 Claims, 8 Drawing Sheets

U.S. PATENT DOCUMENTS 4,019,188 4/1977 Hochberg et al. ..... 346/75
4,106,032 8/1978 Miura et al. ..... 346/140 R
4,113,598 9/1978 Jozwiak, Jr. et al. ..... 204/181 R
4,171,777 10/1979 Behr ..... 239/422
4,189,937 2/1980 Nelson ..... 73/28
4,196,437 4/1980 Hertz ..... 346/1.1
4,265,990 5/1981 Stolka et al. ..... 430/59
4,271,100 6/1981 Trassy ..... 261/78 A
4,284,418 8/1981 Andres ..... 55/16
4,296,317 * 10/1981 Kraus ..... 347/43
4,368,850 1/1983 Szekely ..... 239/333
4,403,228 9/1983 Miura et al. ..... 346/75
4,403,234 9/1983 Miura et al. ..... 346/140 R
4,480,259 10/1984 Kruger et al. ..... 346/140 R
4,490,728 12/1984 Vaught et al. ..... 346/1.1
4,500,895 2/1985 Buck et al. ..... 346/140 R
4,514,742 4/1985 Suga et al. ..... 346/140 R
4,515,105 5/1985 Danta et al. ..... 118/629
4,523,202 6/1985 Gamblin ..... 346/75
4,544,617 10/1985 Mort et al. ..... 430/58
4,606,501 8/1986 Bate et al. ..... 239/346
4,607,267 8/1986 Yamamuro ..... 346/140 R
4,613,875 9/1986 Le et al. ..... 346/140 R
4,614,953 9/1986 Lapeyre ..... 346/140 R
4,634,647 1/1987 Jansen et al. ..... 430/84
4,647,179 3/1987 Schmidlin ..... 355/3 DD
4,663,258 5/1987 Pai et al. ..... 430/57
4,666,806 5/1987 Pai et al. ..... 430/57
4,683,481 7/1987 Johnson ..... 346/140 R
4,720,444 1/1988 Chen ..... 430/58
4,728,969 3/1988 Le et al. ..... 346/140 R
4,741,930 5/1988 Howard et al. ..... 427/265
4,760,005 7/1988 Pai ..... 430/65
4,770,963 9/1988 Pai et al. ..... 430/64
4,839,232 6/1989 Morita et al. ..... 428/473.5
4,839,666 6/1989 Jayne ..... 346/75
4,870,430 9/1989 Daggett et al. ..... 346/140 R
4,882,245 11/1989 Gelorme et al. ..... 430/14
4,896,174 1/1990 Stearns ..... 346/459
4,929,968 5/1990 Ishikawa ..... 346/140 R
4,961,966 10/1990 Stevens et al. ..... 427/299
4,973,379 11/1990 Brock et al. ..... 156/640
4,982,200 1/1991 Ramsay ..... 346/75
5,030,536 7/1991 Pai et al. ..... 430/127
5,041,849 8/1991 Quate et al. ..... 346/140 R
5,045,870 9/1991 Lamey et al. ..... 346/140 R
5,063,655 11/1991 Lamey et al. ..... 29/611
5,066,512 11/1991 Goldowsky et al. ..... 427/14.1
5,113,198 5/1992 Nishikawa et al. ..... 346/1.1
5,190,817 3/1993 Terrell et al. ..... 428/343
5,202,704 4/1993 Iwao ..... 346/140 R
5,208,630 5/1993 Goodbrand et al. ..... 355/201
5,209,998 5/1993 Kavassalis et al. ..... 430/106
5,240,153 8/1993 Tubaki et al. ..... 222/385
5,240,842 8/1993 Mets ..... 435/172.3
5,294,946 3/1994 Gandy et al. ..... 346/140 R
5,300,339 4/1994 Hays et al. ..... 428/36.9
5,350,616 9/1994 Pan et al. ..... 428/131
5,363,131 11/1994 Momose et al. ..... 347/46
5,385,803 1/1995 Duff et al. ..... 430/138
5,403,617 4/1995 Haaland ..... 427/180
5,422,698 * 6/1995 Kawada et al. ..... 354/331
5,425,802 6/1995 Burton et al. ..... 95/32
5,426,458 6/1995 Wenzel et al. ..... 347/45
5,428,381 6/1995 Hadimioglu et al. ..... 347/46
5,482,587 1/1996 McAleavey ..... 156/243
5,510,817 4/1996 Sohn ..... 347/21
5,512,712 4/1996 Iwata et al. ..... 174/258
5,520,715 5/1996 Oeftering ..... 75/335
5,522,555 6/1996 Poole ..... 241/33
5,535,494 7/1996 Plesinger et al. ..... 29/25.35
5,541,625 7/1996 Holstun et al. ..... 347/5
5,554,480 9/1996 Patel et al. ..... 430/137
5,600,351 2/1997 Holstun et al. ..... 347/40
5,604,519 2/1997 Keefe et al. ..... 347/13
5,635,969 6/1997 Allen ..... 347/96
5,640,187 6/1997 Kashiwazaki et al. ..... 347/101
5,646,656 7/1997 Leonhardt et al. ..... 347/43
5,654,744 8/1997 Nicoloff, Jr. et al. ..... 347/43
5,666,142 * 9/1997 Fujita et al. ..... 347/59
5,678,133 10/1997 Siegel ..... 399/67
5,682,190 10/1997 Hirosawa et al. ..... 347/94
5,712,669 1/1998 Swanson et al. ..... 347/49
5,717,986 2/1998 Vo et al. ..... 399/291
5,731,048 3/1998 Ashe et al. ..... 427/585
5,756,190 5/1998 Hosomi et al. ..... 428/209
5,761,783 6/1998 Osawa et al. ..... 29/25.35
5,777,636 7/1998 Naganuma et al. ..... 347/10
5,787,558 8/1998 Murphy ..... 29/25.35
5,818,477 10/1998 Fullmer et al. ..... 347/43
5,828,388 10/1998 Cleary et al. ..... 347/21
5,850,587 * 12/1998 Schmidlin ..... 399/258
5,853,906 12/1998 Hsieh ..... 428/690
5,882,830 3/1999 Visser et al. ..... 430/59
5,893,015 4/1999 Mojarradi et al. ..... 399/291
5,900,898 5/1999 Shimizu et al. ..... 347/93
5,958,122 9/1999 Fukuda et al. ..... 106/31.57
5,967,044 10/1999 Marschke ..... 101/363
5,968,674 10/1999 Hsieh et al. ..... 428/690
5,969,733 10/1999 Sheinman ..... 347/75
5,981,043 11/1999 Murakami et al. ..... 428/209
5,982,404 11/1999 Iga et al. ..... 347/173
5,990,197 11/1999 Escano et al. ..... 523/160
5,992,978 11/1999 Fujii et al. ..... 347/54
6,019,466 2/2000 Hermanson ..... 347/104
6,036,295 3/2000 Ando et al. ..... 347/7
6,116,718 * 9/2000 Peeters et al. ..... 347/21
6,136,442 * 10/2000 Wong ..... 428/412
6,177,222 * 1/2001 McAneney et al. ..... 430/124

* cited by examiner

PARTICULATE MARKING MATERIAL TRANSPORT APPARATUS UTILIZING TRAVELING ELECTROSTATIC WAVES

CROSS-REFERENCE TO RELATED APPLICATIONS

The present invention is related to U.S. patent application Ser. Nos. 09/163,893, 09/164,124, 09/164,250, 09/163,808, 09/163,765, 09/163,954, 09/163,924, 09/163,799, 09/163,664, 09/163,518, and 09/164,104, issued U.S. patent Ser. Nos. 5,422,698, 5,717,986, 5,853,906, 5,893,015, 5,893,015, 5,968,674, 6,116,442, and 6,136,442, each of the above being incorporated herein by reference.

BACKGROUND

The present invention relates generally to the field of printing apparatus, and more particularly to devices and methods for moving and metering marking material in such devices.

There are a variety of marking systems currently known which utilize ejection of liquid inks for marking a substrate. Ink jet and acoustic ink ejection are two common examples. Systems ejecting liquid inks present several problems as the spot size is decreased, such as when designing to increase the resolution of a printer. For example, to produce a smaller spot on a substrate, the cross-sectional area of the channel and/or orifice through which the ink must be ejected is decreased. Below a certain cross-sectional area, viscosity inhibits proper flow of the ink, adversely affecting spot position control, spot size control, etc. Thus, there has been proposed apparatus for marking by ejecting a dry or solid, particulate marking material (hereafter particulate marking material), for example the ballistic aerosol marking apparatus of the aforementioned U.S. patent application Ser. No. 09/163,893.

One problem encountered with the use of particulate marking material is in the transport of that material from a reservoir holding such material to the point of delivery. With liquid inks, the material may flow through a channel or the like. However, particulate material tends not to flow, tends to clog, and otherwise may require transport augmentation.

Another problem encountered with the use of particulate marking material is in the metering of the material for delivery to a substrate. In order to enable proper spot size control, grey scale marking, and the like, it is necessary to introduce a precisely controlled, or metered amount of marking material, at a precisely controlled rate, and at a precisely controlled time for delivery to the substrate.

In U.S. Pat. 5,717,986, it is suggested that a grid of interdigitated electrodes may be employed, in conjunction with external driving circuitry, to generate an electrostatic traveling wave, which wave may transport toner particles from a sump to a latent image retention surface (e.g., a photoreceptor) for development. The system is relatively large, and as described, applies to a flexible donor belt used in ionographic or electrophotographic imaging and printing apparatus. As described, it is not suited to application in a particle ejection-type printing apparatus, as will be further described.

Traveling waves have been employed for transporting toner particles in a development system, for example as taught in U.S. patent Ser. No. 4,647,179, which is hereby incorporated by reference. According to said patent, the traveling wave is generated by alternating voltages of three or more phases applied to a linear array of conductors placed about the periphery of a conveyor. The force F for moving the toner about the conveyor is given by $F=Q\cdot E_t$, where Q is the charge on the toner particles, and $E_t$ is the tangential field supplied by a multi-phase a.c. voltage applied to the array of conductors. Toner is presented to the conveyor by means of a magnetic brush, which is rotated in the same direction as the traveling wave. This gives an initial velocity to the toner particles which enables toner having a relatively lower charge to be propelled by the wave. Again, as described, this approach is not suited to application in a particle ejection-type printing apparatus, as will be further described.

SUMMARY

The present invention is a novel design and application of a grid of interdigitated electrodes to produce a traveling electrostatic wave capable of transporting and metering particulate marking material which overcomes the disadvantages referred to above. In particular, the grid of electrodes is sized to be employable within a print head, for example having a channel to channel spacing (pitch) of 50 to 250 $\mu$m. At the sizes of interest, it becomes possible to photolithographically form the grid of electrodes on a print head substrate. In certain embodiments, it may be possible to form the electrostatic grid using known complementary metal oxide semiconductor (CMOS) fabrication techniques. In such embodiments, the required driving circuitry may be formed simultaneously with the electrode grid, simplifying manufacture, reducing cost, and reducing the size of the completed print head.

According to another embodiment, electrical connection is made between the electrodes and the driving circuitry by interconnection lines oriented generally perpendicular to the long axis of the electrodes. The interconnection lines pass under or over the electrodes. As the spacing between the electrodes and the perpendicular interconnection lines decreases to accommodate a reduction in size of the electrode grid, cross talk is avoided by staggering the electrode and interconnection line order.

Transport of particulate marking material is accomplished by positioning one end of the electrode grid in proximity to a marking material delivery station (e.g., within a sump containing marking material, at a point of delivery of an electrostatic donor roll, etc.) and establishing an electrostatic traveling wave in the direction of desired marking material motion. The opposite end of the electrode grid is placed proximate a point of discharge, such as a port in a channel through which a propellant flows in the aforementioned ballistic aerosol marking apparatus. The traveling wave may be modulated to meter the transport as desired.

Thus, the present invention and its various embodiments provide numerous advantages including, but not limited to, a compact particulate marking material transport and metering device, which in one embodiment may include integrated driving electronics, and in another embodiment may have staggered electrodes, etc., as will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as electrode width, height, pitch, etc. These recited ranges are to be treated as examples only, and are not intended to limit the scope of the claims hereof. In addition, a number of materials are identified as suitable for various facets of the embodiments, such as for the substrate, electrodes, etc. These recited materials are also to be treated as exemplary, and are not intended to limit the scope of the claims hereof.

Figure 1:
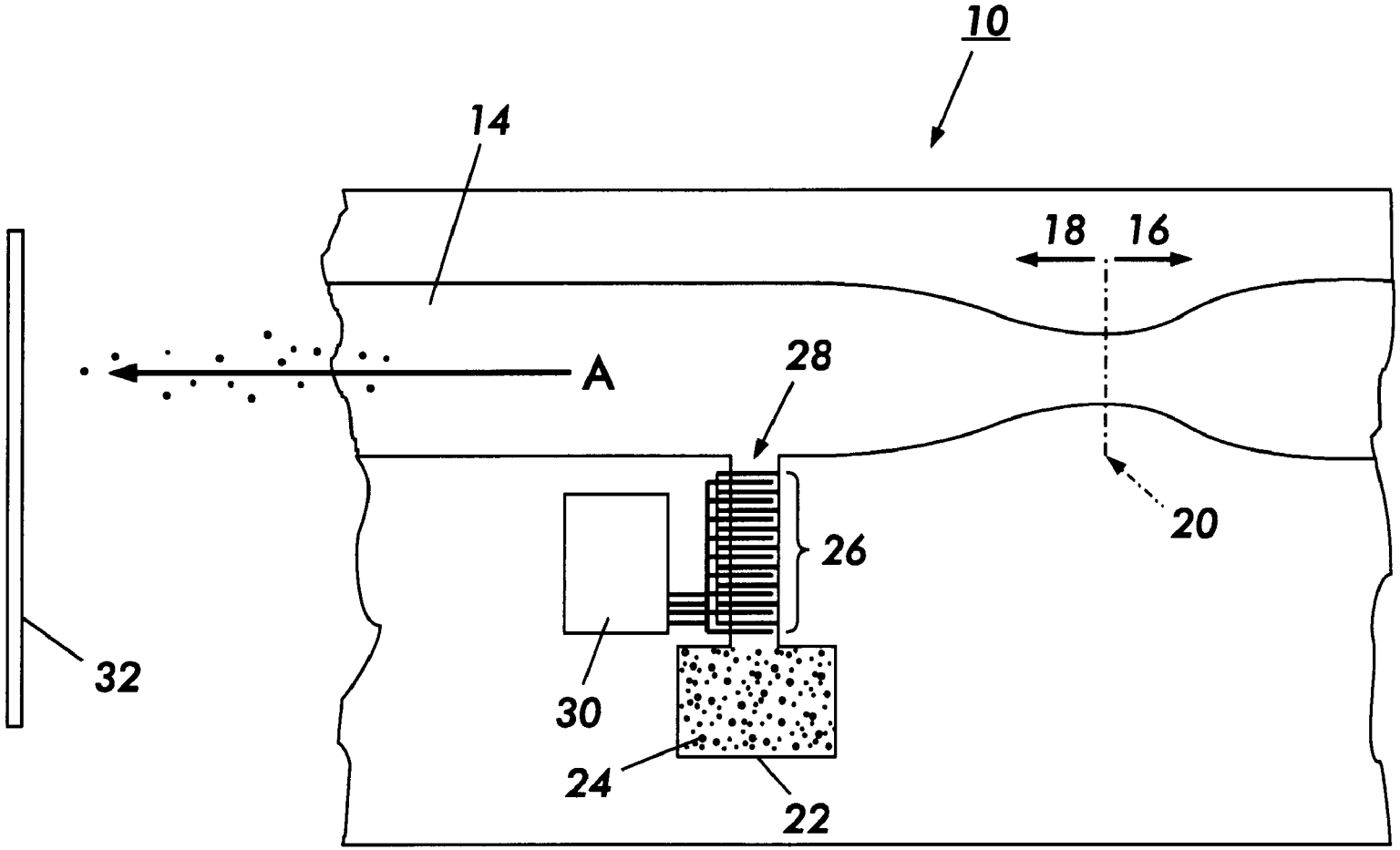
FIG. 1 is an illustration of a ballistic aerosol marking apparatus of the type employing a marking material transport and metering device according to one embodiment of the present invention.

FIG. 1 illustrates a ballistic aerosol marking apparatus 10 employing a particulate marking material transport and metering device 12 according to one embodiment of the present invention. Apparatus 10 consists of a channel 14 having a converging region 16, a diverging region 18, and a throat 20 disposed therebetween.

Marking material transport and metering device 12 consists of a marking material reservoir 22 containing marking material particles 24. Connected to reservoir 22 is electrode grid 26, illustrated and described further below. Electrode grid 26 terminates at an injection port 28 in channel 14, for example in the diverging region 18. Connected to electrode grid 26 is driving circuitry 30, also illustrated and described further below.

The particulate marking material employed by the present invention may or may not be charged, depending on the desired application. In the event that a charged particulate marking material is employed, the charge on the marking material may be imparted by way of a corona (not shown) located either internal or external to the marking material reservoir 22.

In operation, a traveling electrostatic wave is established by driving circuitry 30 cross electrode grid 26 in a direction from reservoir 22 toward injection port 28. Marking material particles in the reservoir 22 which are positioned proximate the electrode grid 26, for example by gravity feed, are transported by the traveling electrostatic wave in the direction of injection port 28. Once the marking material particles reach the injection port 28, they are introduced into a propellant stream (not shown) and carried thereby in the direction of arrow A toward a substrate 32 (for example sheet paper, etc.)

Figure 2:
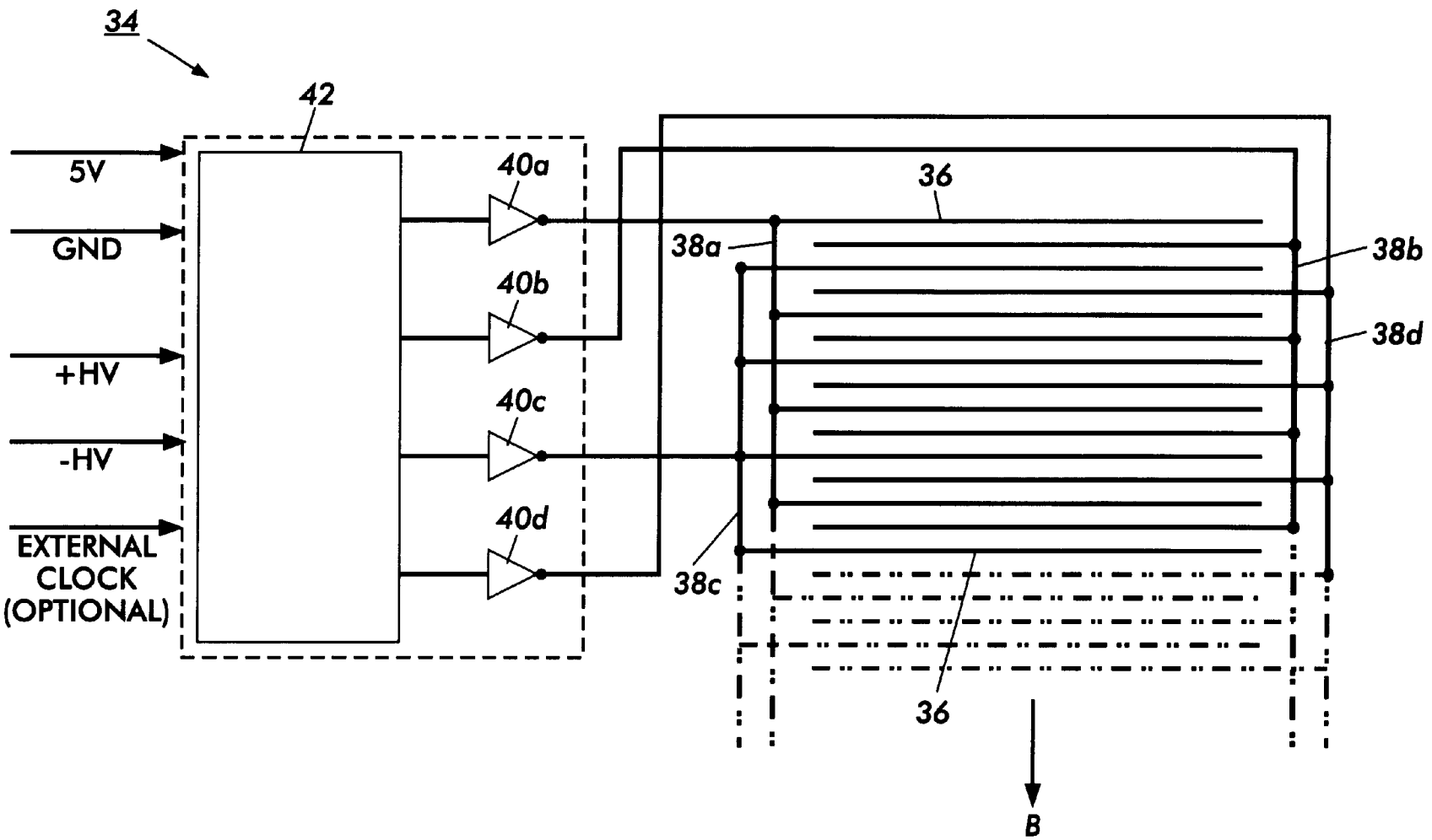
FIG. 2 is a schematic illustration of a portion of a marking material transport and metering device according to one embodiment of the present invention.

FIG. 2 is a schematic illustration of a portion of a particulate marking material transport device 34 according to one embodiment of the present invention. Device 34 consists of a plurality of interdigitated electrodes 36, organized into at least three, preferably four groupings 38*a*, 38*b*, 38*c*, and 38*d*. Each group 38*a*, 38*b*, 38*c*, and 38*d* is connected to an associated driver 40*a*, 40*b*, 40*c*, and 40*d*, respectively. Each of drivers 40*a*, 40*b*, 40*c*, and 40*d*, respectively, may be an inverting amplifier or other driver circuit, as appropriate. Each driver 40*a*, 40*b*, 40*c*, and 40*d* is connected to clock generator and logic circuitry 42, illustrated and described further below.

Figure 3:
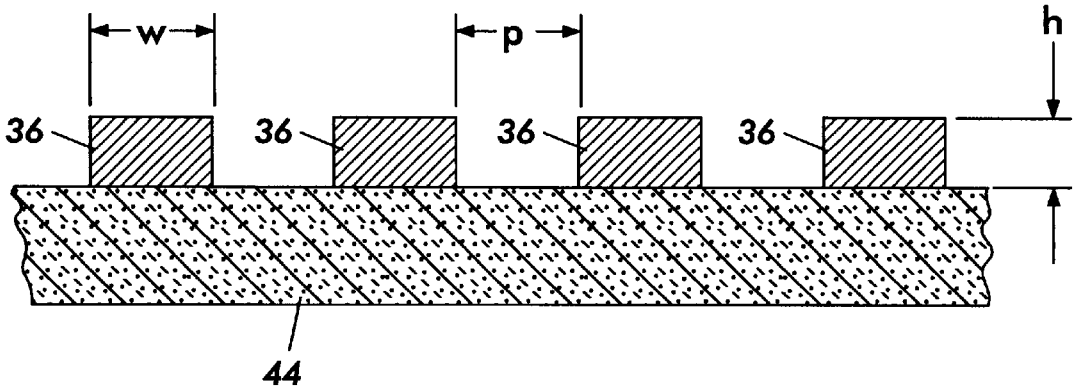
FIG. 3 is a cross-sectional view of a substrate having formed thereon electrodes according to one embodiment of the present invention.

With reference to FIG. 3, shown therein is a cross section of a substrate 44 on which are formed electrodes 36. In one embodiment, electrodes 36 have a height between 0.2 $\mu$m and 1.0 $\mu$m, preferably 0.6 $\mu$m for CMOS process compatibility described further below. Electrodes 36 have a width w of between 5 $\mu$m and 50 $\mu$m, preferably 25 $\mu$m, and a pitch of between 5 $\mu$m and 50 $\mu$m, preferably 25 $\mu$m. The width and pitch of electrodes 36 will in part be determined by the size of the marking material particles to be employed.

Returning to FIG. 2, in operation, control signals from the clock generator and logic circuitry 42 are applied to drivers 40*a*, 40*b*, 40*c*, 40*d* and these drivers sequentially provide a phased voltage for example, 25–250 volts preferably in the range of 125 volts, to the electrodes 36 to which they are connected. It will be noted that in order to establish a sufficient traveling wave at least three groups of electrodes are required, meaning that a voltage source of at least three phases is required. However, a greater number of groups and a great number of voltage phases may be employed as determined by the desired application of the present invention.

A typical operating frequency for the voltage source is between a few hundred Hertz and 5 kHz depending on the charge and the type of marking material in use. The traveling wave may be d.c. phase or a.c. phase, with d.c. phase preferred.

Figure 4:
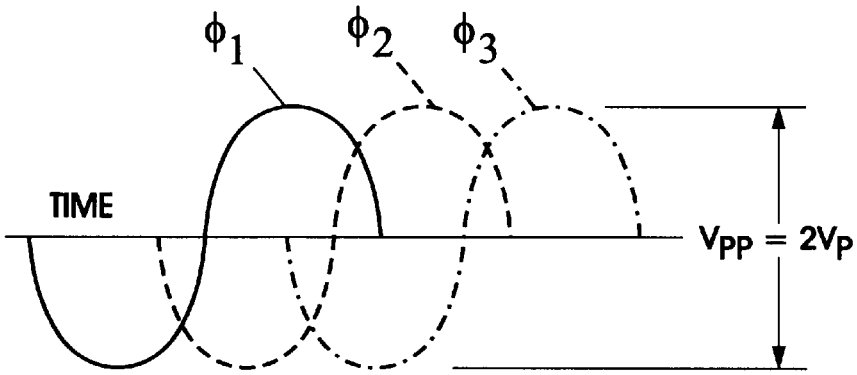
FIG. 4 is a sample waveform (sinusoidal) of a type employed in one embodiment of the present invention.

The force F required to move a marking material particle from one electrode 36 to an adjacent electrode 36 is given by $F=Q\cdot E_t$, where Q is the charge on the marking material particle, and $E_t$ is the tangential field established by the electrodes, given by $E_t=[1/d][V_{\phi^1}(t)-V_{\phi^2}(t)]$. In the later equation, d is the spacing between electrodes, and $V_{\phi^1}(t)$ and $V_{\phi^2}(t)$ are the voltages of the two adjacent electrodes, typically varying as a function of time. For peak a.c. voltage $v_p$ from a sinusoidal waveform of the type shown in FIG. 4 (three-phase), the resulting field $E_t$ is given by $E_t(v_p)=[1/d][v_p\sin(\overline{\omega}_t)+v_p\sin(\overline{\omega}_t+\phi]$, where $\phi$ is the phase difference between the two voltage waveforms. The maximum field thus depends on the phase of the waveform. The largest filed is obtained when the phase difference between the two waveforms is 180 degrees. In this case, the field equation reduces to $E_t=2v_p/d$.

However, a sinusoidal system can never achieve this maximum value since with a 180 degree phase shift in the waveform, the traveling wave looses directionality. Thus, the phase shift must always be something less (or more) than 180 degrees.

Figure 5:
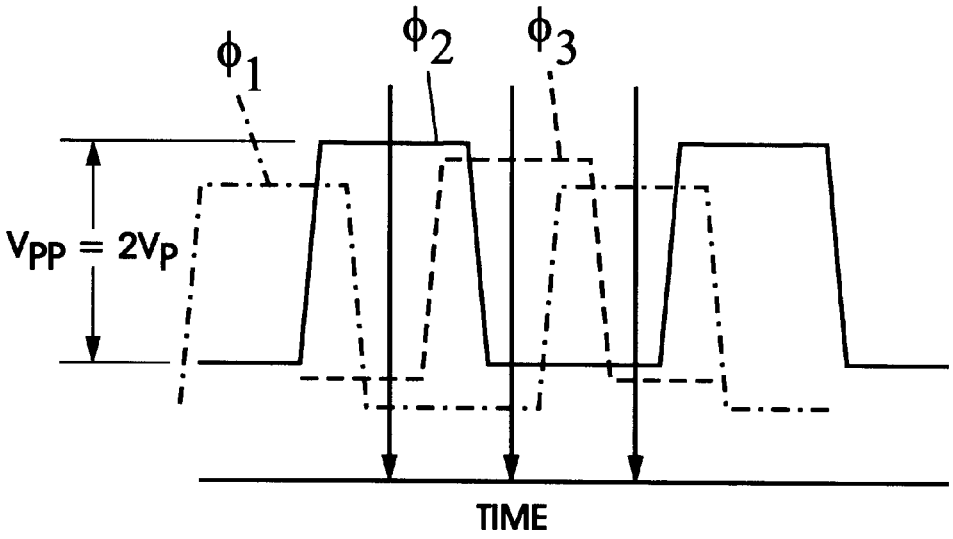
FIG. 5 is sample waveform (trapezoidal) of a type employed in another embodiment of the present invention.

However, a phased d.c. waveform is able to achieve the $E_t=2v_p/d$ maximum field without loosing directionality of the traveling wave. FIG. 5 illustrates a three-phase trapezoidal d.c. waveform preferably employed in the present invention. The maximum $E_t=2v_p/d$ is obtained during the time that all but one of the waveforms have a zero voltage. At this time, the waveforms have sufficient overlap to impart directionality to the traveling wave established by the electrodes.

Figure 6:
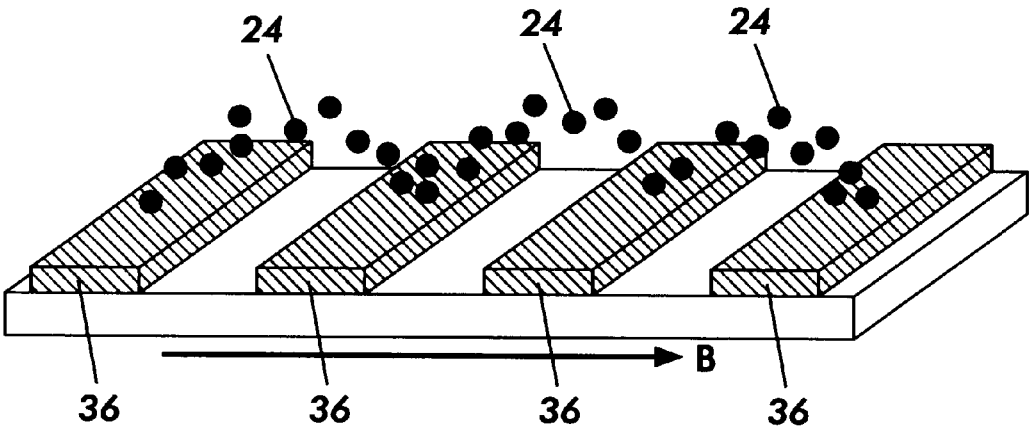
FIG. 6 is a perspective view of a portion of a marking material transport and metering device according to one embodiment of the present invention, in operation.

Again returning to FIG. 2, in either the case of an a.c. or d.c. waveform, a traveling wave is established across the electrode grid in the direction of arrow B. Particles 24 of marking material travel from electrode to electrode, for example due to their attraction to an oppositely charge electrode, as shown in FIG. 6.

Figure 7:
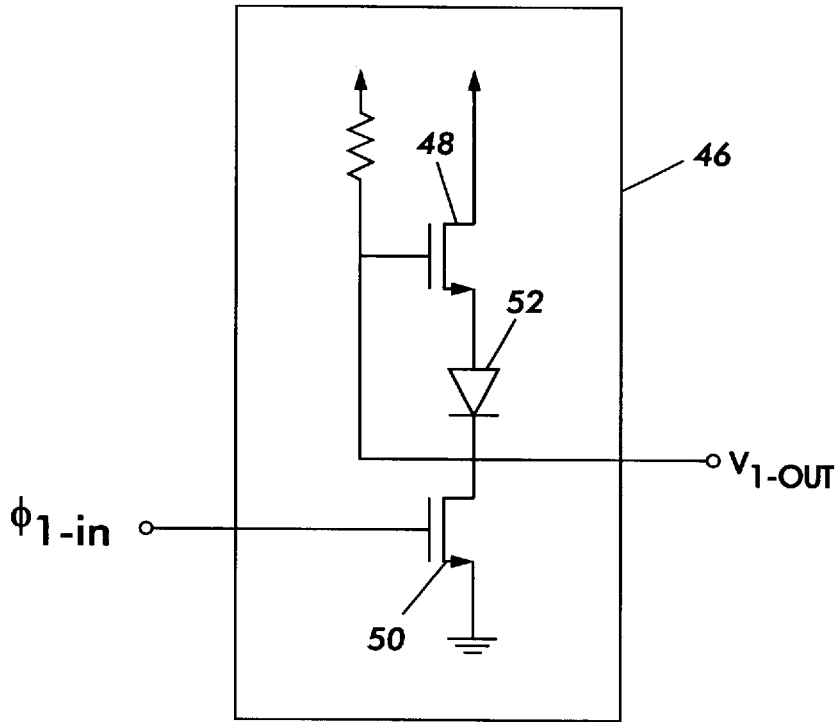
FIG. 7 is a schematic illustration of one embodiment of clock and logic circuitry used to generate a phased voltage waveform according to one embodiment of the present invention.
Figure 8:
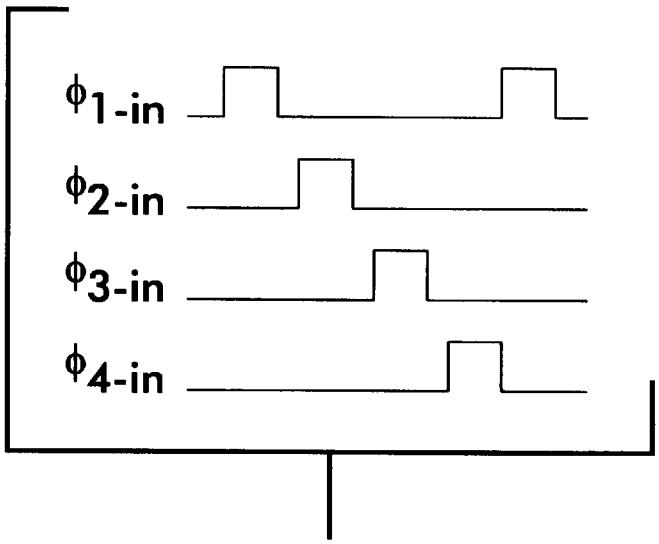
FIG. 8 is an illustration of the input waveforms for clock and logic circuitry according to one embodiment of the present invention.

FIG. 7 is a schematic illustration of one embodiment of a portion 46 of clock and logic circuitry 42 used to generate the phased voltage waveform referred to above. A portion 46 is required for each group 38*a*, 38*b*, 38*c*, and 38*d* of electrodes. Portion 46 consists of a first high voltage transistor 48, a second high voltage transistor 50, and a diode 52 connected as a push-pull output driver of a type known in the art. The input to portion 46 is a digital input $\phi_{1\text{-}in}$. This input would be generated by convention low voltage logic, and would have a waveform relative to the inputs $\phi_{2\text{-}in}$, $\phi_{3\text{-}in}$, and $\phi_{4\text{-}in}$ of the other groups shown by FIG. 8. Portion 46 converts the digital input $\phi_{1\text{-}in}$ into the high voltage waveform $v_{1\text{-}out}$, which is applied to the electrodes 36. Clocking of the circuit is thus handled by the low voltage logic.

Figure 9:
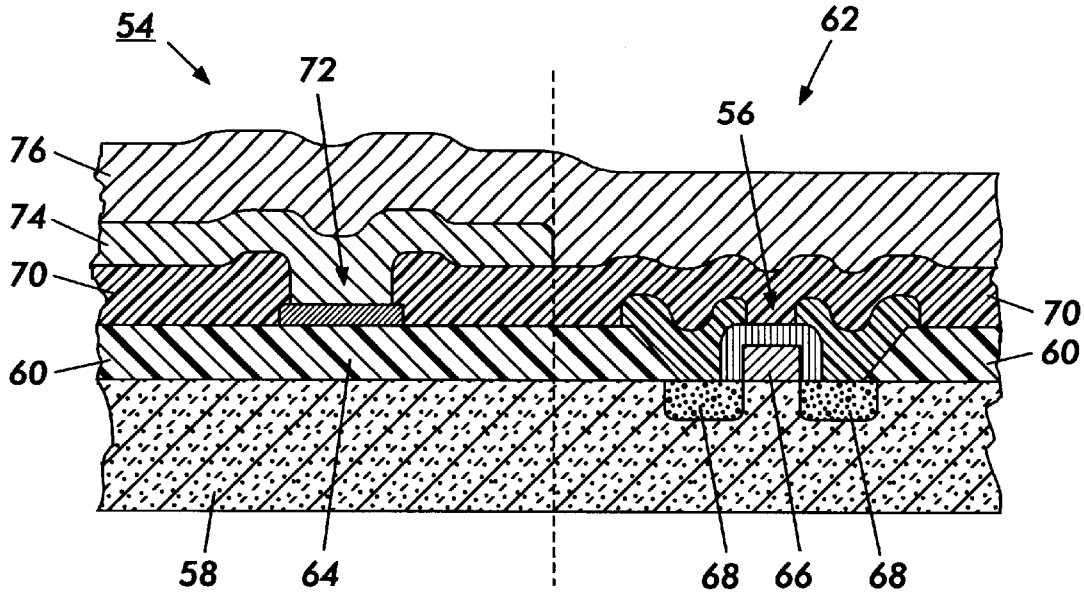
FIG. 9 is a cross-sectional illustration of a marking material transport and metering device, with an integrated electrode and thin film transistor structure, according to one embodiment of the present invention.

Fabrication of electrodes 36 and required interconnections may be done in conjunction with the fabrication of associated circuitry such as drivers 40*a*, 40*b*, 40*c*, and 40*d*, and clock and logic circuitry 42. According to one embodiment, a conventional CMOS process is used to form these elements. A portion 54 of a marking material transport device with integrated circuitry (e.g., transistor 56) may be manufactured by a process described with reference to FIG. 9. The process begins with the provision of an appropriate conventional substrate 58, such as silicon, glass, etc. Over substrate 58 is deposited a field oxide 60. A transistor region 62 is formed in field oxide 60 in the form of a depression therein. Aluminum or similar metal is next deposited and patterned to form interconnection 64 (connecting electrodes 36) and simultaneously gate 66. n+ doped regions (or n− regions) 68 are next provided in the transistor region, using gate 66 as a mask, to provide source and drains for transistor 56. A passivation layer 70, such as glass, is next deposited over the structure, and a via 72 is formed therein to permit electrical connection to interconnect 64. A metal electrode layer 74 is next formed over the structure, and patterned to form electrodes 36. Finally, a coating layer 76 overlays the structure for physical protection, electrical isolation, and other functions discussed in the aforementioned and incorporated U.S. patent applications Ser. Nos. 09/163,518, 09/163,664 and U.S. Pat. No. 6,136,442.

Figure 10:
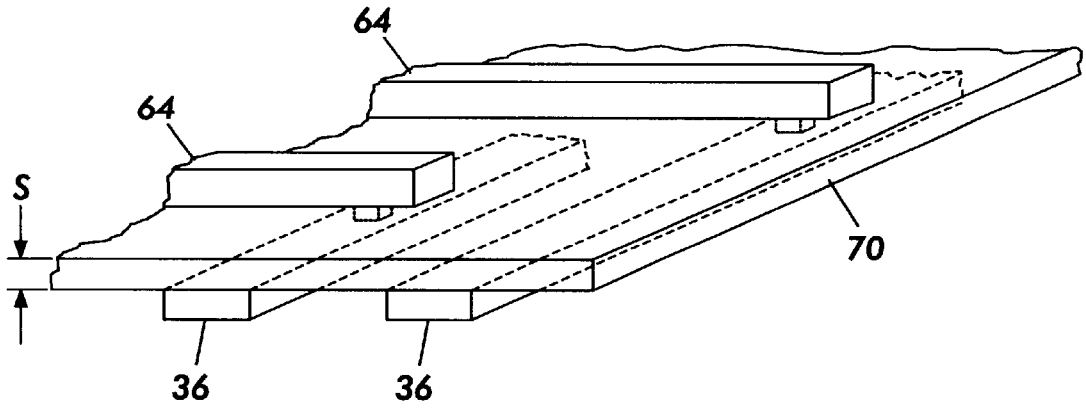
FIG. 10 is a perspective view of two electrodes and interconnection in electrical communication according to one embodiment of the present invention.
Figure 11:
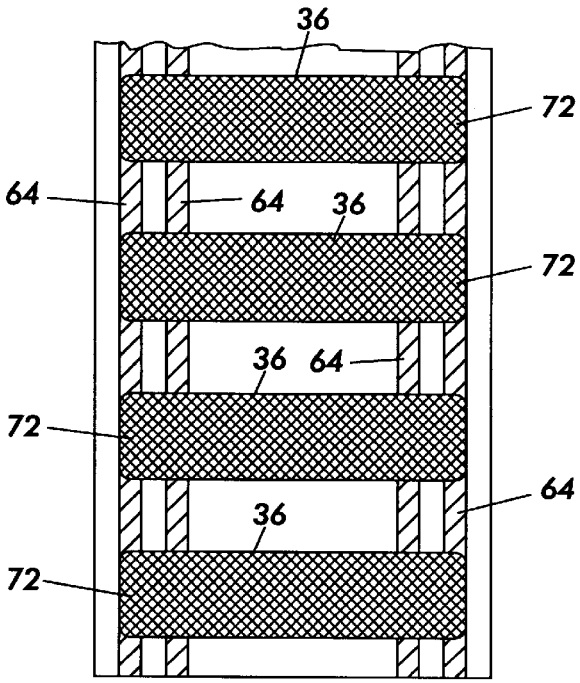
FIG. 11 PRIOR ART
FIG. 11 is plan view of a prior art arrangement of electrodes and interconnections.

As will be appreciated, the marking material transport device of the present invention includes a plurality of electrodes 36 and interconnections 64, arranged in overlapping fashion as illustrated in FIG. 10 (inverted for illustration purposes only). As the size of the marking material transport device is reduced, the spacings between the electrodes 36 and the interconnections 64 is reduced commensurately. We have discovered that in such a case, cross talk between the various interconnections and electrodes 36 increases. Thus, we have designed an interconnection scheme which reduces or eliminates this cross-talk. Shown in FIG. 11 is an interconnection scheme of the type contemplated by the aforementioned U.S. Pat. No. 5,717,986, and U.S. Pat. No. 5,893,015. According to this interconnection scheme, each electrode 36 is connected to an interconnection 64 in a stair-step fashion. That is, the first, left-most interconnection is connected to the first, lowest electrode 36, the second from the left interconnection 64 connected to the second from the lowest electrode 36, etc. Accordingly, each interconnection underlies each electrode. At each point that an interconnection underlies an electrode, other than the electrode to which it is directly connected by way of via 72, the signal carried by the interconnection may undesirably cause a signal through the passivation to other electrodes-hence cross-talk.

Figure 12:
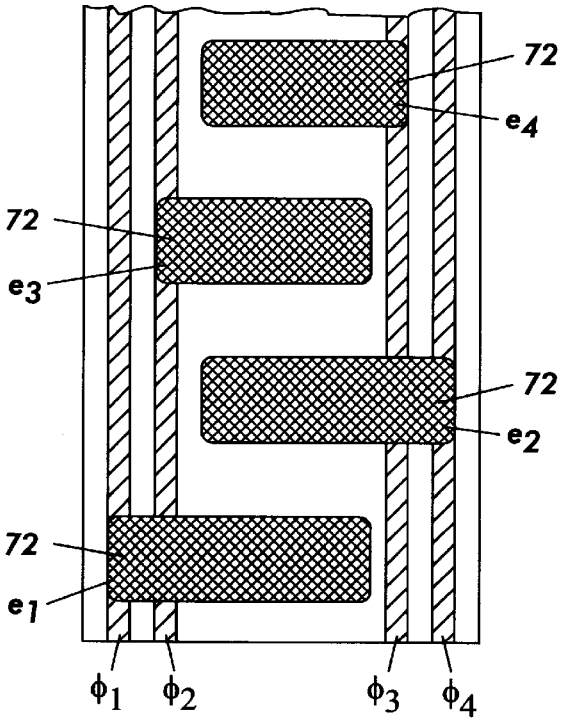
FIG. 12 is an illustration of one embodiment of an electrode and interconnection arrangement according to the present invention.

Accordingly, we have developed the interconnection scheme illustrated in FIG. 12 with the goal of eliminating this cross-talk. For purpose of this explanation, we refer to the interconnections as $\phi_1$, $\phi_2$, $\phi_3$, and $\phi_4$, and the electrodes as $e_1$, $e_2$, $e_3$, and $e_4$, and assume that the electrodes overly the interconnections. As shown in FIG. 12, a via 72 connects $\phi_1$ and $e_1$, with $e_1$ overlying only $\phi_3$. Likewise, a via 72 connects $\phi_2$ and $e_2$, with $e_2$ overlying only $\phi_4$. Similarly, a via 72 connects $\phi_3$ and $e_3$, with no interconnection overlaid by $e_3$. And finally, a via 72 connects $\phi_4$ and $e_4$, with no interconnection overlaid by $e_4$. In this way, each electrode overlays the fewest number of interconnections, while at the same time minimizing the size of the complete structure (for a given electrode and interconnection size). As no overlaid interconnection is adjacent in phase to the electrode which overlays it, the effects of cross talk are minimized or eliminated.

Figure 13:
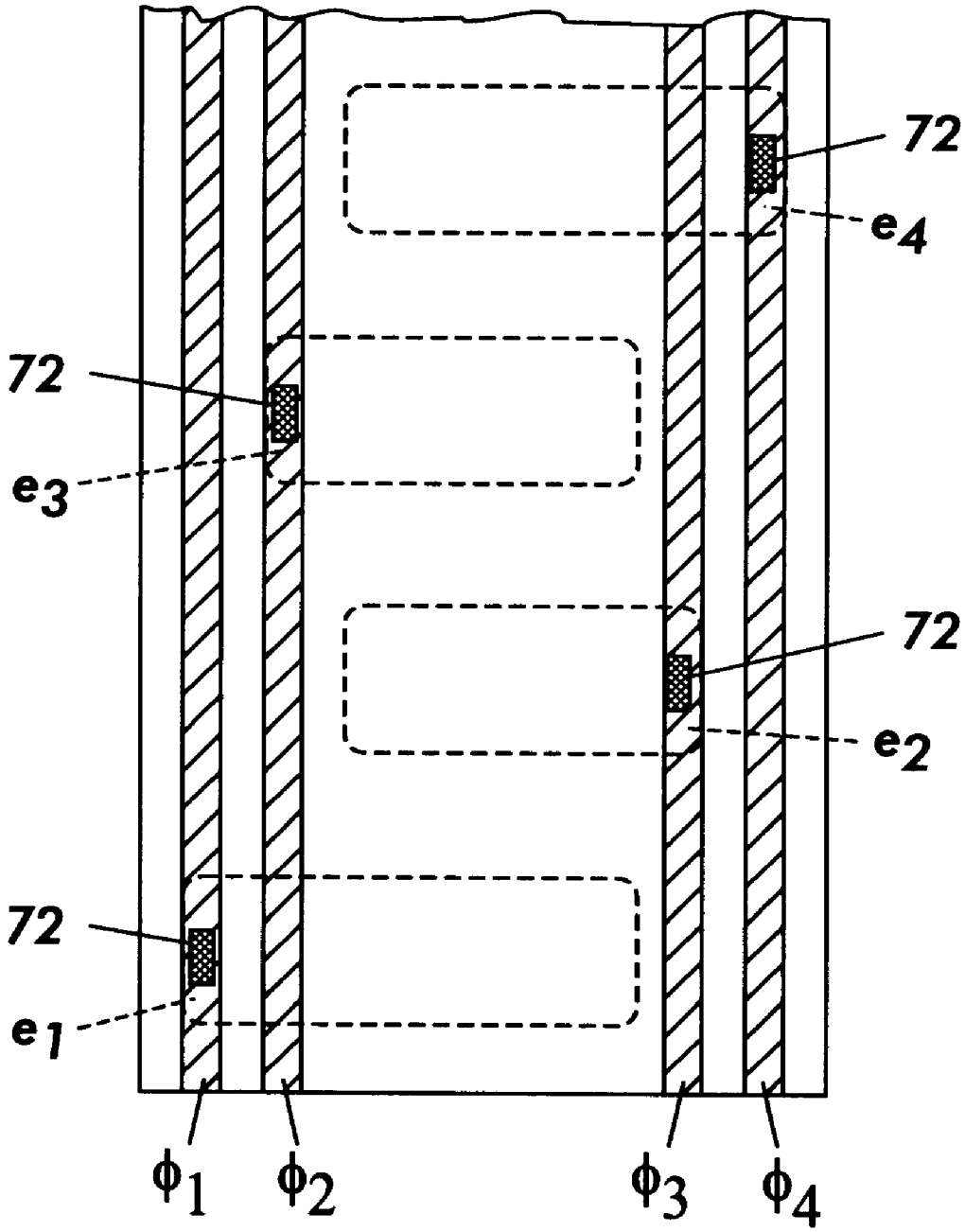
FIG. 13 is an illustration of another embodiment of an electrode and interconnection arrangement according to the present invention.

Of course, other electrode and interconnection arrangements are possible which serve the purpose of eliminating cross talk. For example, the positions of $\phi_2$ and $\phi_4$ in the scheme shown in FIG. 12 may be switched, as shown in FIG. 13. In general, no two adjacent interconnections are overlaid by adjacent electrodes. The important point is the recognition of the problem, and the provision of an architecture to address it.

It will now be appreciated that various embodiments of a particulate marking material transport device have been disclosed herein. The embodiments described and alluded to herein are capable of transporting marking material both intentionally charged and uncharged. Driving electronics may be integrally formed with an array of interdigitated electrodes. The electrodes may be staggered so as to minimize or eliminate cross talk. A plurality of such transports may be used in conjunction to provide multiple colors of marking material to a full color printer, to transport marking material not otherwise visible to the unaided eye (e.g., magnetic marking material), surface finish or texture material, etc. Thus, it should be appreciated that the description herein is merely illustrative, and should not be read to limit the scope of the invention nor the claims hereof.

What is claimed is:

1. A marking material transport apparatus, comprising;

a substrate having a central electrode region and first and second interconnection regions located at lateral peripheries of the electrode region;

at least three electrodes formed over said substrate, each said electrode having a longitudinal axis extending between an interconnection end located in either said first or said second interconnection regions and a distal end located in said central electrode region;

at least three interconnection lines, at least two of said interconnections lines located in said first interconnection region, and at least one of said interconnection lines located in said second interconnection region;

said at least three electrodes and said at least three interconnection lines spaced apart from one another, and electrically isolated from one another, by an insulation layer, said insulation layer having formed therein a plurality of vias, each via having electrically conductive material located therein, such that each of said at least three electrodes is in electrical communication with one of said at least three interconnection lines;

said at least three electrodes arranged such that no adjacent two electrodes are in electrical communication with two interconnections located in the same interconnection region.

2. The marking material transport apparatus of claim 1, wherein said electrodes have a width in a direction perpendicular to said longitudinal axis of at least 5 $\mu$m but no greater than 50 $\mu$m.

3. The marking material transport apparatus of claim 2, wherein said electrodes are spaced apart from one another by a width in a direction perpendicular to said longitudinal axis of at least 5 $\mu$m but no greater than 50 $\mu$m.

4. The marking material transport apparatus of claim 1, further comprising driving circuitry connected to said interconnection lines, for providing a sequential charge to said electrodes to thereby generate an electrostatic traveling wave in a direction perpendicular to said longitudinal axis, capable of transporting particulate marking material.

5. The marking material transport apparatus of claim 4, wherein said driving circuitry is formed directly on said substrate.

6. The marking material transport apparatus of claim 5, wherein said driving circuitry provides driving voltages to said electrodes, via said interconnection lines, having a trapezoidal waveform such that the waveform for a selected electrode overlaps in time with the waveform for each adjacent electrode.

7. A marking material transport apparatus, comprising:

a substrate;

an oxide layer formed on said substrate;

a plurality of transport electrodes formed on said oxide layer, each said transport electrode having a longitudinal axis extending from an interconnection end to an electrode end;

a plurality of transistor gate electrodes formed on said oxide layer;

a plurality of doped regions formed in said substrate, each said gate electrode having a doped region located at opposite lateral edges thereof;

a plurality of source and drain contacts, each source and drain contact formed over and in electrical communication with a doped region which, together with one of said gate electrodes, are capable of forming a transistor;

a plurality of interconnection lines, each interconnection line in electrical communication with one, and only one, of said transport electrodes and one, and only one, of said source or drain contacts;

whereby, each transport electrode is provided with a charge, under control of said transistor connected to it by said interconnection line, in a sequential order such that a traveling electrostatic wave is established across said electrodes in a direction perpendicular to said longitudinal axis.

8. The marking material transport apparatus of claim 7, wherein said transport electrodes have a width in a direction perpendicular to said longitudinal axis of at least 5 $\mu$m but no greater than 50 $\mu$m.

9. The marking material transport apparatus of claim 8, wherein said transport electrodes are spaced apart from one another by a width in a direction perpendicular to said longitudinal axis of at least 5 $\mu$m but no greater than 50 $\mu$m.

10. A marking material transport apparatus, comprising:

a substrate;

an oxide layer formed on said substrate;

a plurality of transistor gate electrodes formed on said oxide layer;

a plurality of doped regions formed in said substrate, each said gate electrode having a doped region located at opposite lateral edges thereof;

a plurality of source and drain contacts, each source and drain contact formed over and in electrical communication with a doped region which, together with one of said gate electrodes, are capable of forming a transistor;

a plurality of interconnection lines formed on said oxide layer, each said interconnection line in electrical communication with one, and only one, of said source or drain contacts;

a plurality of transport electrodes, each said transport electrode having a longitudinal axis extending from an interconnection end to an electrode end, each said transport electrode in electrical communication with one, and only one, interconnection line;

whereby, each transport electrode is provided with a charge, under control of said transistor connected to it by said interconnection line, in a sequential order such that a traveling electrostatic wave is established across said electrodes in a direction perpendicular to said longitudinal axis.

11. The marking material transport apparatus of claim 10, wherein said transport electrodes have a width in a direction perpendicular to said longitudinal axis of at least 5 $\mu$m but no greater than 50 $\mu$m.

12. The marking material transport apparatus of claim 11, wherein said transport electrodes are spaced apart from one another by a width in a direction perpendicular to said longitudinal axis of at least 5 $\mu$m but no greater than 50 $\mu$m.

* * * * *

UNITED STATES PATENT AND TRADEMARK OFFICE

CERTIFICATE OF CORRECTION

PATENT NO. : 6,290,342 B1
APPLICATION NO. : 09/163839
DATED : September 18, 2001
INVENTOR(S) : Tuan Anh Vo et al.

It is certified that error appears in the above-identified patent and that said Letters Patent is hereby corrected as shown below:

Column 1, line 14, insert as a new paragraph:

This invention was made with US Government support under 70NANB8H4014 awarded by NIST. The Government has certain rights in this invention.

Signed and Sealed this

First Day of May, 2007

JON W. DUDAS
*Director of the United States Patent and Trademark Office*